US008257035B2

(12) United States Patent
Schilp

(10) Patent No.: US 8,257,035 B2
(45) Date of Patent: Sep. 4, 2012

(54) TURBINE VANE FOR A GAS TURBINE ENGINE

(75) Inventor: Reinhard Schilp, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1551 days.

(21) Appl. No.: 11/950,810

(22) Filed: Dec. 5, 2007

(65) Prior Publication Data

US 2009/0148280 A1 Jun. 11, 2009

(51) Int. Cl.
*F03B 3/18* (2006.01)

(52) U.S. Cl. ..... 415/208.1

(58) Field of Classification Search ..... 415/115, 415/208.1; 416/96 R, 97 R
See application file for complete search history.

(56) References Cited

U.S. PATENT DOCUMENTS

| | | | | |
|---|---|---|---|---|
| 3,420,502 | A * | 1/1969 | Howald | 415/115 |
| 4,128,928 | A | 12/1978 | Shotts et al. | |
| 4,312,624 | A | 1/1982 | Steinbauer, Jr. et al. | |
| 4,601,638 | A | 7/1986 | Hill et al. | |
| 4,798,515 | A | 1/1989 | Hsia et al. | |
| 5,259,727 | A | 11/1993 | Quinn | |
| 5,626,462 | A | 5/1997 | Jackson et al. | |
| 5,931,638 | A | 8/1999 | Krause et al. | |
| 6,174,135 | B1 | 1/2001 | Lee | |
| 6,241,466 | B1 | 6/2001 | Tung et al. | |
| 6,402,470 | B1 | 6/2002 | Kvasnak et al. | |
| 6,672,059 | B2 | 1/2004 | Arnold | |
| 6,715,988 | B2 | 4/2004 | Leeke et al. | |
| 6,830,428 | B2 | 12/2004 | Le Biez et al. | |
| 6,962,484 | B2 | 11/2005 | Brandl et al. | |
| 6,974,308 | B2 | 12/2005 | Halfmann et al. | |
| 7,037,075 | B2 | 5/2006 | Townes et al. | |
| 7,052,238 | B2 | 5/2006 | Whitesell et al. | |
| 7,070,391 | B2 | 7/2006 | Weisse | |
| 2003/0049127 | A1 * | 3/2003 | Tiemann | 416/97 R |
| 2005/0163620 | A1 | 7/2005 | Whitesell et al. | |
| 2006/0222496 | A1 | 10/2006 | Lee et al. | |
| 2006/0280607 | A1 | 12/2006 | Harvey et al. | |
| 2007/0104570 | A1 | 5/2007 | Boegli et al. | |
| 2007/0128042 | A1 | 6/2007 | Weisse et al. | |
| 2007/0160455 | A1 | 7/2007 | Peterson et al. | |

* cited by examiner

*Primary Examiner* — Nathaniel Wiehe

(57) ABSTRACT

A turbine vane for a gas turbine engine having an outer wall of non-uniform thickness. The turbine vane may be formed from a generally elongated airfoil formed from an outer wall having a leading edge, a trailing edge, a pressure side, a suction side, a first endwall at a first end, a second endwall at a second end opposite the first end, and an internal cooling system positioned internally of the outer wall. The outer wall may be formed of a non-uniform thickness such that aspects of the outer wall positioned between an outboardmost portion of the outer wall and an inboardmost portion of the outer wall are thinner than the outboardmost and inboardmost portions of the outer wall.

6 Claims, 3 Drawing Sheets

TURBINE VANE FOR A GAS TURBINE ENGINE

FIELD OF THE INVENTION

This invention is directed generally to gas turbine engines, and more particularly to turbine vanes for gas turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are exposed to high temperature combustor gases that heat the airfoil. The airfoils include an internal cooling system for reducing the temperature of the airfoils. While there exist many configurations of cooling systems, there exists a need for improved cooling of gas turbine airfoils.

SUMMARY OF THE INVENTION

This invention is directed to a turbine vane for a gas turbine engine. The turbine vane may be configured to better accommodate high combustion gas temperatures than conventional vanes. In particular, the turbine vane may include an internal cooling system positioned within internal aspects of the vane and contained within an outer wall forming the vane. The outer wall may be formed from a non-uniform thickness such that aspects of the vane that are susceptible to the largest temperature gradients within the vane, such as at the leading edge, have thinner thicknesses facilitating easier cooling of those regions. An outer surface of the outer wall may extend generally linearly between the first and second ends of the generally elongated airfoil, and an inner surface of the outer wall may be nonlinear because of accommodating the non-uniform wall thickness. Thus, the outerwall may be tapered internally, not externally. Such a configuration facilitates improved manufacturability of the film cooling holes because the outer surface is linear and improves shape variation of diffuser sections of external film cooling holes.

The turbine vane may be formed from a generally elongated airfoil formed from an outer wall and having a leading edge, a trailing edge, a pressure side, a suction side, a first endwall at a first end, a second endwall at a second end opposite the first end, and an internal cooling system positioned internally of the outer wall. The outer wall may be formed of a non-uniform thickness such that an outer surface of the outer wall extends generally linearly between the first and second ends of the generally elongated airfoil and an inner surface of the outer wall is nonlinear because of accommodating the non-uniform wall thickness.

The outer wall may be formed of a non-uniform thickness such that aspects of the outer wall positioned between an outboardmost portion of the outer wall and an inboardmost portion of the outer wall are thinner than the outboardmost and inboardmost portions of the outer wall. The outer wall at a midpoint between the outboardmost and inboardmost portions of the outer wall may have a thickness that is less than thicknesses of the outer wall at the outboardmost and inboardmost portions of the outer wall. In one embodiment, the outer wall between the midpoint and the outboardmost portion may have a linearly increasing wall thickness going from the midpoint to the outboardmost portion. Similarly, the outer wall between the midpoint and the inboardmost portion may have a linearly increasing wall thickness going from the midpoint to the inboardmost portion. In another embodiment, the outer wall between the midpoint and the outboardmost portion may have a nonlinearly increasing wall thickness going from the midpoint to the outboardmost portion. Likewise, the outer wall between the midpoint and the inboardmost portion may have a nonlinearly increasing wall thickness going from the midpoint to the inboardmost portion.

An advantage of this invention is that the configuration of the outer wall increases the castability of the turbine vane.

Another advantage of this invention is that the internally tapered outer wall improves manufacturability of the film cooling holes because of the linear outer surface of the outer wall, thereby enabling the electrodes used to form film cooling orifices to be straight, which improves the shape variation of the diffuser sections of the external film cooling holes.

Yet another advantage of this invention is that by having a linear outer surface, aerodynamic influences caused by tapered surfaces are not present, thereby simplifying aerodynamic analysis of the turbine vane.

Another advantage of this invention is that in airfoils including impingement rib inserts welded or brazed into place proximate to the leading edge, the internal wall taper may act as a safety feature if that weld or braze fails because the insert will move towards and be supported by one of the walls in the cavity. However, the impingement insert can only contact the ID and OD portions of the internally tapered outer wall, thereby maintaining a gap between the impingement insert and the wall to continue cooling the wall forming the leading edge. In addition, the ID and OD portions that the impingement insert contacts are generally colder and can handle a lack of cooling from the failed impingement insert.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
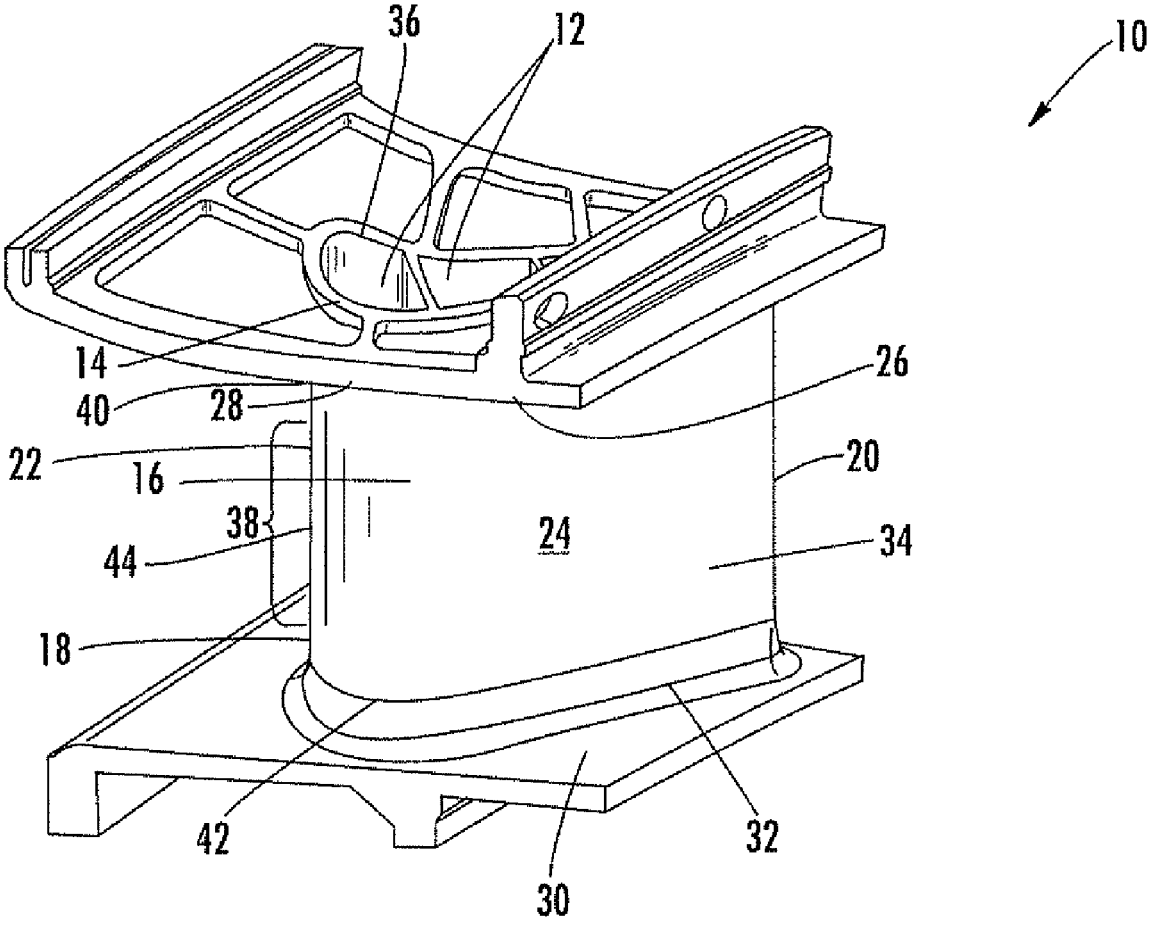
FIG. 1 is a perspective view of a turbine vane with aspects of this invention.

As shown in FIGS. 1-4, this invention is directed to a turbine vane 10 for a gas turbine engine. The turbine vane 10 may be configured to better accommodate high combustion gas temperatures than conventional vanes. In particular, the turbine vane 10 may include an internal cooling system 12 positioned within internal aspects of the vane 10 and contained within an outer wall 14 forming the vane 10. The outer wall 14 may be formed from a non-uniform thickness such that aspects of the vane 10 that are susceptible to the largest temperature gradients within the vane 10, such as at the leading edge 18, have thinner thicknesses facilitating easier cooling of those regions. An outer surface 34 of the outer wall 14 may extend generally linearly between the first and second ends 28, 32 of the generally elongated airfoil 16, and an inner surface 36 of the outer wall 14 may be nonlinear because of accommodating the non-uniform wall thickness. Thus, the outerwall 14 may be tapered internally, not externally. Such a configuration facilitates improved manufacturability of the film cooling holes because the outer surface 34 is linear and improves shape variation of diffuser sections of external film cooling holes.

Figure 2:
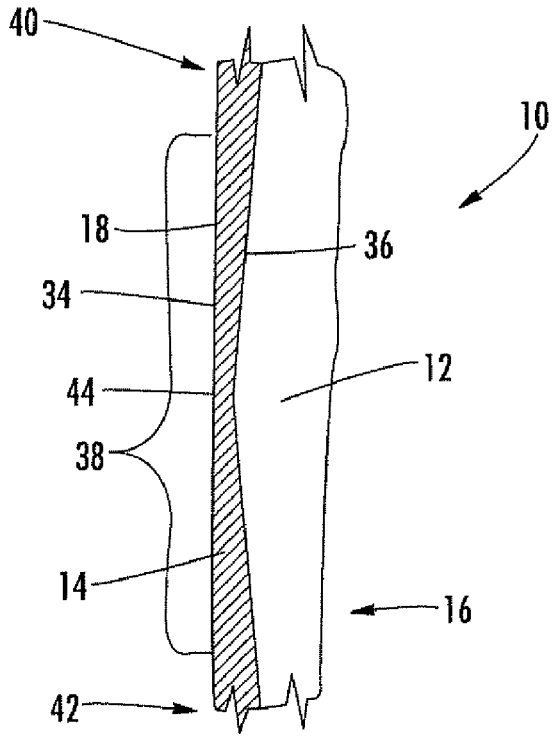
FIG. 2 is a partial cross-sectional view of the outer wall of the turbine vane taken a section line 2-2 in FIG. 1.
Figure 3:
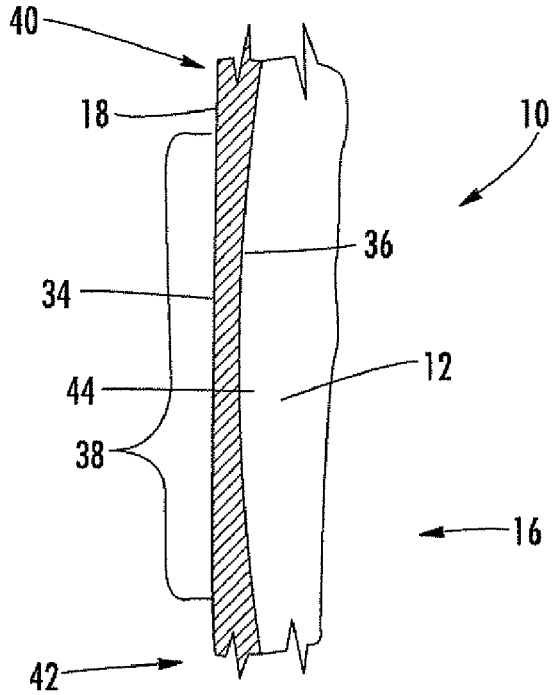
FIG. 3 is a partial cross-sectional view of the outer wall with an alternative configuration of the turbine vane taken a section line 3-3 in FIG. 1.

The turbine vane 10 may be formed from a generally elongated airfoil 16 formed from the outer wall 14. The outer wall 14 may contain the internal cooling system 12 positioned internally of the outer wall 14. The generally elongated airfoil 16 may have a leading edge 18, a trailing edge 20, a pressure side 22, a suction side 24, a first endwall 26 at a first end 28, and a second endwall 30 at a second end 32 opposite the first end 28. The outer wall 14 may be formed from a non-uniform thickness. In particular, aspects of the outer wall 14 may be thinner than other aspects. The outer wall 14 may be formed of a non-uniform thickness such that aspects 38 of the outer wall 14 positioned between an outboardmost portion 40 of the outer wall 14 and an inboardmost portion 42 of the outer wall 14 are thinner than the outboardmost and inboardmost portions 40, 42 of the outer wall 14. For instance, as shown in FIGS. 2 and 3, a midpoint 44 of the outer wall 14 between the outboardmost and inboardmost portions 40, 42 of the outer wall 14 has a thickness that is less than thicknesses of the outer wall 14 at the outboardmost and inboardmost portions 40, 42 of the outer wall 14. In at least one embodiment, the taper may be a change in thickness of the outer wall 14 of 0.15 mm per 25 mm of length extending radially along the airfoil 16 between the outboardmost and inboardmost portions 40, 42.

As shown in FIG. 2, the outer wall 14 between the midpoint 44 and the outboardmost portion 40 may have a linearly increasing wall thickness going from the midpoint 44 to the outboardmost portion 40. Similarly, the outer wall 14 between the midpoint 44 and the inboardmost portion 42 may have a linearly increasing wall thickness going from the midpoint 44 to the inboardmost portion 42. In such a configuration, the inner surface 36 extending between the outboardmost portion 40 and the inboardmost portion 42 may be non-linear. In some embodiments, the thinnest portion of the outer wall 14 may be positioned at locations other than at the midpoint 44.

In another embodiment, as shown in FIG. 3, the outer wall 14 between the midpoint 44 and the outboardmost portion 40 may have a nonlinearly increasing wall thickness going from the midpoint 44 to the outboardmost portion 40. Likewise, the outer wall 14 between the midpoint 44 and the inboardmost portion 42 has a nonlinearly increasing wall thickness going from the midpoint 44 to the inboardmost portion 42. In such a configuration, the inner surface 36 extending between the outboardmost portion 40 and the inboardmost portion 42 may be non-linear.

Figure 4:
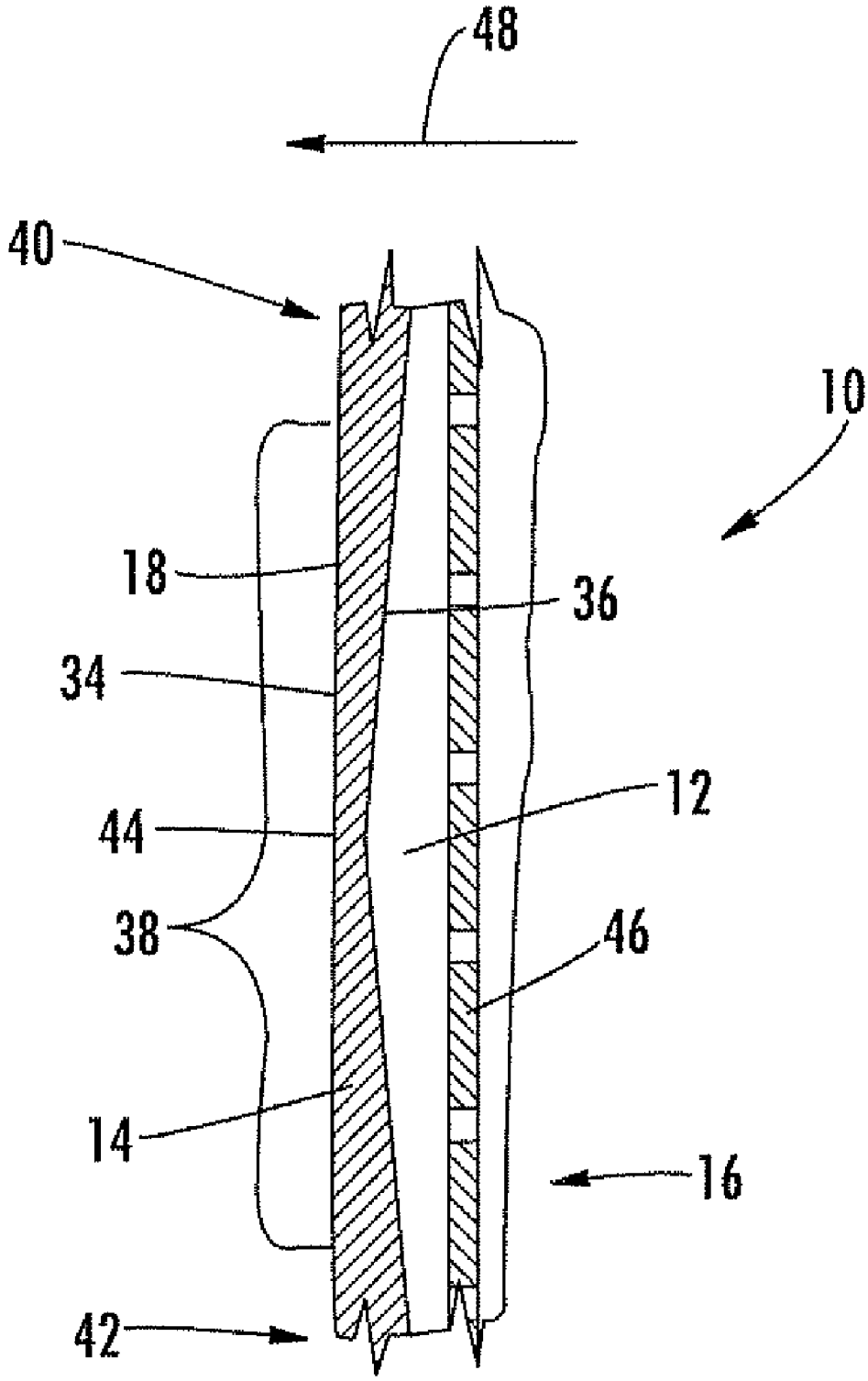
FIG. 4 is a partial cross-sectional view of the outer wall of the turbine vane taken a section line 2-2 in FIG. 1 having an alternative configuration.

In another embodiment, as shown in FIG. 4, the turbine vane 10 may include an impingement rib 46 positioned in the turbine vane 10. The impingement rib 46 may be formed from an insert attached to the vane 10 via brazing, welding or other appropriate method. The impingement rib 46 may also be linear. During use, the impingement rib insert 46 may break off and be forced against the outer wall 14 in the direction of arrow 48. However, due to the shape of the outer wall 14, the impingement rib insert 46 would only contact the ID and OD portions of the outer wall 14, leaving a gap between the inner surface 36 of the outer wall 14 and the impingement rib insert 46. Such a configuration would enable the impingement rib 46 to continue to cool the outer wall 14 in the center, which is the hotter portion of the outer wall 14. The ID and OD portions of the outerwall that contact the impingement rib 46 are generally cooler and able to handle the reduced cooling caused by the damaged impingement rib 46.

The change in thickness of the outer wall 14 not only improves the cooling capacity of the airfoil 16 but also increases the castability of the airfoil 16 in the manufacturing process. In addition, by including the taper on the inner surface 36 and not on the outer surface 34, aerodynamic influences associated with a tapered surface are avoided. The turbine vane 10 may be formed using any appropriate casting method.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine vane for a gas turbine engine, comprising:

a generally elongated airfoil formed from an outer wall, and having a leading edge, a trailing edge, a pressure side, a suction side, a first endwall at a first end, a second endwall at a second end opposite the first end, and an internal cooling system positioned internally of the outer wall;

wherein the outer wall is formed of a non-uniform thickness such that an outer surface of the outer wall extends generally linearly between the first and second ends of the generally elongated airfoil and an inner surface of the outer wall is nonlinear because of accommodating the non-uniform wall thickness;

wherein the outer wall is formed of a non-uniform thickness such that aspects of the outer wall positioned between an outboardmost portion of the outer wall and an inboardmost portion of the outer wall are thinner than the outboardmost and inboardmost portions of the outer wall;

wherein the outer wall at a midpoint between the outboardmost and inboardmost portions of the outer wall has a thickness that is less than thicknesses of the outer wall at the outboardmost and inboardmost portions of the outer wall;

wherein the outer wall between the midpoint and the outboardmost portion has a linearly increasing wall thickness going from the midpoint to the outboardmost portion.

2. The turbine vane of claim 1, wherein the outer wall between the midpoint and the inboardmost portion has a linearly increasing wall thickness going from the midpoint to the inboardmost portion.

3. A turbine vane for a gas turbine engine, comprising:

a generally elongated airfoil formed from an outer wall, and having a leading edge, a trailing edge, a pressure side, a suction side, a first endwall at a first end, a second endwall at a second end opposite the first end, and an internal cooling system positioned internally of the outer wall;

wherein the outer wall is formed of a non-uniform thickness such that an outer surface of the outer wall extends generally linearly between the first and second ends of the generally elongated airfoil and an inner surface of the outer wall is nonlinear because of accommodating the non-uniform wall thickness;

wherein the outer wall is formed of a non-uniform thickness such that aspects of the outer wall positioned between an outboardmost portion of the outer wall and an inboardmost portion of the outer wall are thinner than the outboardmost and inboardmost portions of the outer wall;

wherein the outer wall at a midpoint between the outboardmost and inboardmost portions of the outer wall has a thickness that is less than thicknesses of the outer wall at the outboardmost and inboardmost portions of the outer wall;

wherein the outer wall between the midpoint and the inboardmost portion has a linearly increasing wall thickness going from the midpoint to the inboardmost portion.

4. A turbine vane for a gas turbine engine, comprising:

a generally elongated airfoil formed from an outer wall, and having a leading edge, a trailing edge, a pressure side, a suction side, a first endwall at a first end, a second endwall at a second end opposite the first end, and an internal cooling system positioned internally of the outer wall;

wherein the outer wall is formed of a non-uniform thickness such that an outer surface of the outer wall extends generally linearly between the first and second ends of the generally elongated airfoil and an inner surface of the outer wall is nonlinear because of accommodating the non-uniform wall thickness;

wherein the outer wall is formed of a non-uniform thickness such that aspects of the outer wall positioned between an outboardmost portion of the outer wall and an inboardmost portion of the outer wall are thinner than the outboardmost and inboardmost portions of the outer wall;

wherein the outer wall at a midpoint between the outboardmost and inboardmost portions of the outer wall has a thickness that is less than thicknesses of the outer wall at the outboardmost and inboardmost portions of the outer wall;

wherein the outer wall between the midpoint and the outboardmost portion has a nonlinearly continuously increasing wall thickness going from the midpoint to the outboardmost portion.

5. The turbine vane of claim 4, wherein the outer wall between the midpoint and the inboardmost portion has a nonlinearly increasing wall thickness going from the midpoint to the inboardmost portion.

6. A turbine vane for a gas turbine engine, comprising:

a generally elongated airfoil formed from an outer wall, and having a leading edge, a trailing edge, a pressure side, a suction side, a first endwall at a first end, a second endwall at a second end opposite the first end, and an internal cooling system positioned internally of the outer wall;

wherein the outer wall is formed of a non-uniform thickness such that an outer surface of the outer wall extends generally linearly between the first and second ends of the generally elongated airfoil and an inner surface of the outer wall is nonlinear because of accommodating the non-uniform wall thickness;

wherein the outer wall is formed of a non-uniform thickness such that aspects of the outer wall positioned between an outboardmost portion of the outer wall and an inboardmost portion of the outer wall are thinner than the outboardmost and inboardmost portions of the outer wall;

wherein the outer wall at a midpoint between the outboardmost and inboardmost portions of the outer wall has a thickness that is less than thicknesses of the outer wall at the outboardmost and inboardmost portions of the outer wall;

wherein the outer wall between the midpoint and the inboardmost portion has a nonlinearly continuously increasing wall thickness going from the midpoint to the inboardmost portion.

* * * * *